US005484130A

United States Patent [19]

Domanski et al.

[11] Patent Number: 5,484,130

[45] Date of Patent: Jan. 16, 1996

[54] SUPPORT COLUMN FOR USE IN A MINE

[75] Inventors: Lothar Domanski, Oberhausen; Rudi Podjadtke, Herne, both of Germany

[73] Assignee: Bochumer Eisenhutte Heintzmann GmbH & Co. KG, Bochum, Germany

[21] Appl. No.: 330,714

[22] Filed: Oct. 28, 1994

[30] Foreign Application Priority Data

Nov. 13, 1993 [DE] Germany ..... 43 38 831.0

[51] Int. Cl.[6] ..... A47F 5/00

[52] U.S. Cl. ..... 248/354.3; 248/357; 405/288

[58] Field of Search ..... 248/354.3, 354.1, 248/351, 357; 52/126.2, 648; 405/288

[56] References Cited

U.S. PATENT DOCUMENTS

| | | | |
|---|---|---|---|
| 568,471 | 9/1896 | Ball | 248/354.3 X |
| 1,572,856 | 2/1926 | Watson | 248/354.3 X |
| 2,544,780 | 3/1951 | Dean | 248/354.3 X |
| 3,737,134 | 6/1973 | Foon . | |
| 4,122,645 | 10/1978 | Tooley | 52/648 |
| 4,234,151 | 11/1980 | John | 248/354.3 X |
| 5,015,125 | 5/1991 | Seegmiller | 405/288 |
| 5,056,753 | 10/1991 | Lunau | 248/354.3 X |

FOREIGN PATENT DOCUMENTS

| | | | |
|---|---|---|---|
| 279163 | 3/1952 | Switzerland | 248/354.3 |
| 768608 | 2/1957 | United Kingdom | 248/354.3 |

*Primary Examiner*—J. Franklin Foss
*Attorney, Agent, or Firm*—Herbert Dubno; Andrew Wilford

[57] ABSTRACT

An adjustable column for use between ceiling and floor surfaces of a mine has an outer tube having an outer end and an inner end and an inner tube having an inner end in the outer tube at the inner end thereof and an outer end. The tubes are coaxial to an upright axis and an external screwthread on the outer-tube inner end fits with an inner screwthread on the inner-tube inner end so that the tubes can be screwed relative to each other to change the axial length of the column. One of the outer ends is operatively braced against one of the surfaces and the other outer end is spaced from the other of the surfaces. A resiliently compressible support element is braced axially between the other outer end and the other surface.

8 Claims, 3 Drawing Sheets

SUPPORT COLUMN FOR USE IN A MINE

FIELD OF THE INVENTION

The present invention relates to a support column. More particularly this invention concerns such a column that is vertically braced between the floor and ceiling of a mine.

BACKGROUND OF THE INVENTION

As described in U.S. Pat. No. 3,737,134 of Foon a vertically resilient column comprises telescoping inner and outer tubes. The lower end of the outer tube stands on the ground and the upper end of the inner tube bears on the roof or ceiling. The upper end of the outer tube is frustoconically upwardly flared and annular wedges engage between this flared region and the inner tube. These wedges allow the tubes to be moved axially apart but resist movement together as the wedges bite into the inner tube. The wedges permit some downward movement of the inner tube in the outer tube, giving the column its vertical resiliency. The upper end of the inner tube is formed as a nut into which is threaded a massive bolt whose upper end bears via a rigid dished plate on the ceiling, this plate having no significant resiliency. The setting force, that is the vertical load the column is set to bear, is established by screwing this bolt out of the column against the ceiling.

This arrangement is relatively complex and expensive. Accurately establishing the desired setting force is fairly difficult.

OBJECTS OF THE INVENTION

It is therefore an object of the present invention to provide an improved column for use in a mine.

Another object is the provision of such an improved column for use in a mine which overcomes the above-given disadvantages, that is which is relatively simple in construction and easy to use.

SUMMARY OF THE INVENTION

An adjustable column for use between ceiling and floor surfaces of a mine has according to the invention an outer tube having an outer end and an inner end and an inner tube having an inner end in the outer tube at the inner end thereof and an outer end. The tubes are coaxial to an upright axis and an external screwthread on the outer-tube inner end fits with an inner screw-thread on the inner-tube inner end so that the tubes can be screwed relative to each other to change the axial length of the column. One of the outer ends is operatively braced against one of the surfaces and the other outer end is spaced from the other of the surfaces. A resiliently compressible support element is braced axially between the other outer end and the other surface.

The invention is based on the recognition that a screwthread between the column tubes can be used to establish the setting force. A wrench or arm is used to allow the tubes to be rotated relative to each other. Normally according to the invention the inner tube is generally below the outer tube and engages the floor surface. In addition the support element can rotate about the axis relative to the outer tube, so same can easily be rotated between the inner tube and the element to establish the setting force. The screwthreads can be cut directly in the tubes or into rings set in the tubes.

According to the invention the one end is formed with a concave seat turned toward the one surface and the resiliently compressible support element is an elastically deformable plate sitting complementarily on the seat and capable of rocking thereon like in a ball-and-socket joint. The plate is concave away from the column and axially engages the one surface. It is formed with internal generally frustoconical stiffening webs flaring away from the one surface. In addition the one surface is the ceiling surface and the plate forms with the one surface a chamber. This chamber can be filled with a stiff elastomeric material.

In accordance with the invention another such resiliently compressible support element is braced axially between the one outer end and the one surface. The plate can be formed centrally with a pin projecting into the seat, concave away from the column, and axially engaging the one surface. Means is provided beneath the seat secured to the pin for retaining the element in place on the seat.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
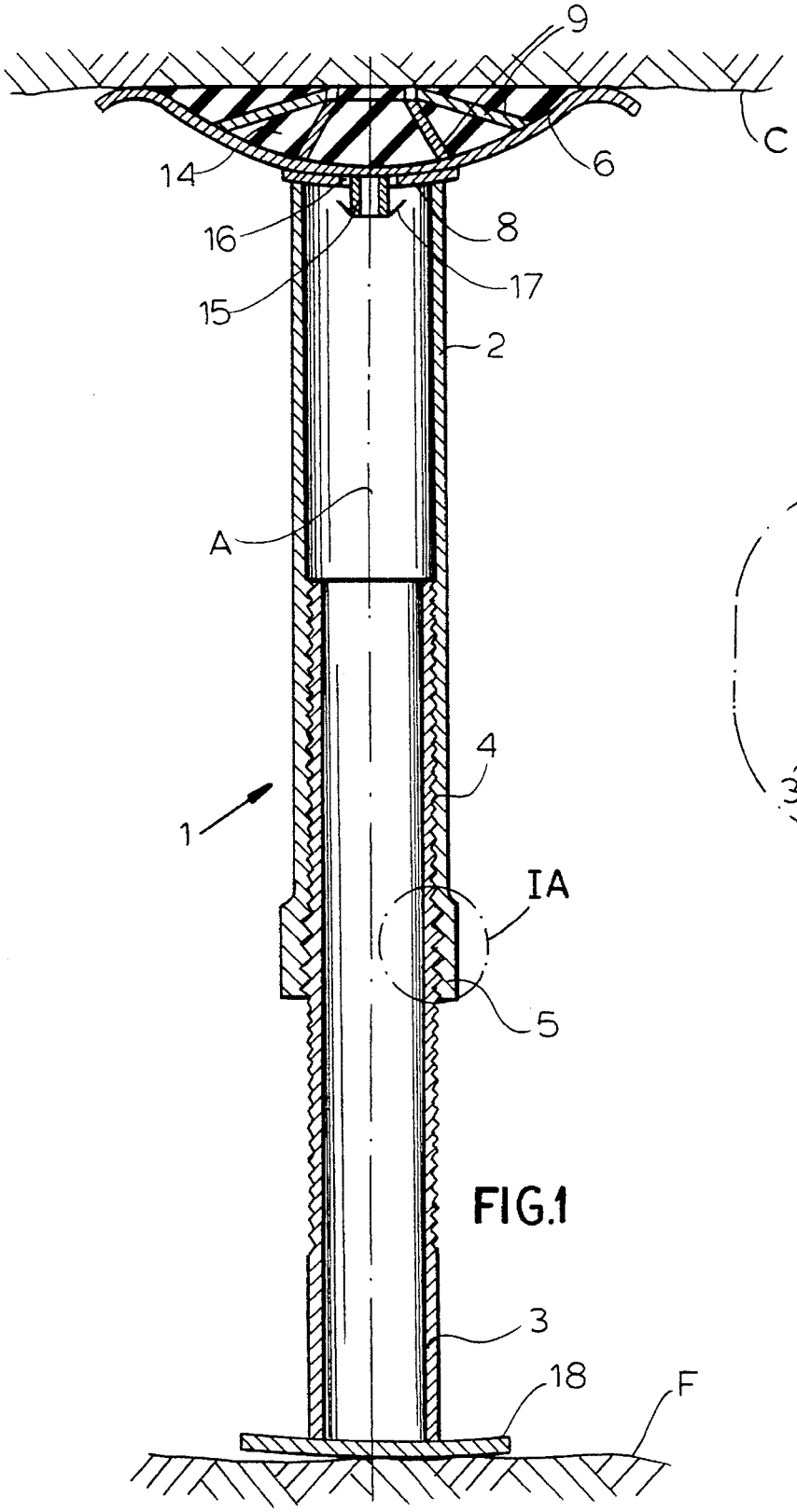
FIG. 1 is a small-scale vertical section through the column according to the invention.
Figure 1A:
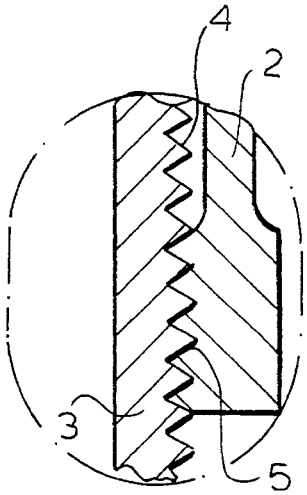
FIG. 1*a* is a large-scale view of the detail indicated at IA in FIG. 1.

As seen in FIGS. 1 and 1A a support column or post 1 is engaged between a ceiling surface C and floor surface F of a mine, extending along and centered on a vertical axis A. The post 1 is comprised of a cylindrical outer tube 2 and a coaxial but smaller-diameter cylindrical inner tube 3 both made of steel. The inner tube 3 is formed along most of its length with an external screwthread 4 and the lower end of the outer tube 2 is formed with a complementary internal screwthread 5. The pitch of the screwthreads 4 and 5 and coefficient of friction of their surfaces is such that virtually no amount of axially effective force is capable all alone of rotating the one tube relative to the other.

The bottom end of the small-diameter inner tube 3 sits via a slightly upwardly dished plate 18 on the floor surface F. At its upper end the larger-diameter outer tube 2 is provided centered on the axis A with an upwardly concave part-spherical plate 8 forming a seat holding an upwardly dished steel disk 6 also centered on the axis A. The disk 6 constitutes a support element and has a rim annularly engaging the ceiling surface C to form therewith a chamber filled with a mass 14 of compressible material, for instance a foamed plastic or a foamed concrete. In addition two frustoconical and annular webs 9 tapering upward and also centered on the axis A add some rigidity to the support element formed by the disk 6 and mass 14, while still allowing it to be compressed axially as visible by a comparison of FIGS. 1 and 2.

At its bottom the disk 6 is provided with a downwardly extending centering pin 15 that fits loosely through a central hole 16 in the seat plate 8. At its lower end the pin 15 has spreadable retainer fingers 17 so that prior to installation the disk 6 will be retained on the post 1. Thus the element 6, 9, 14 can rock somewhat, as in a ball-and-socket joint, on the seat 8 at the top of the column 1.

Figure 2:
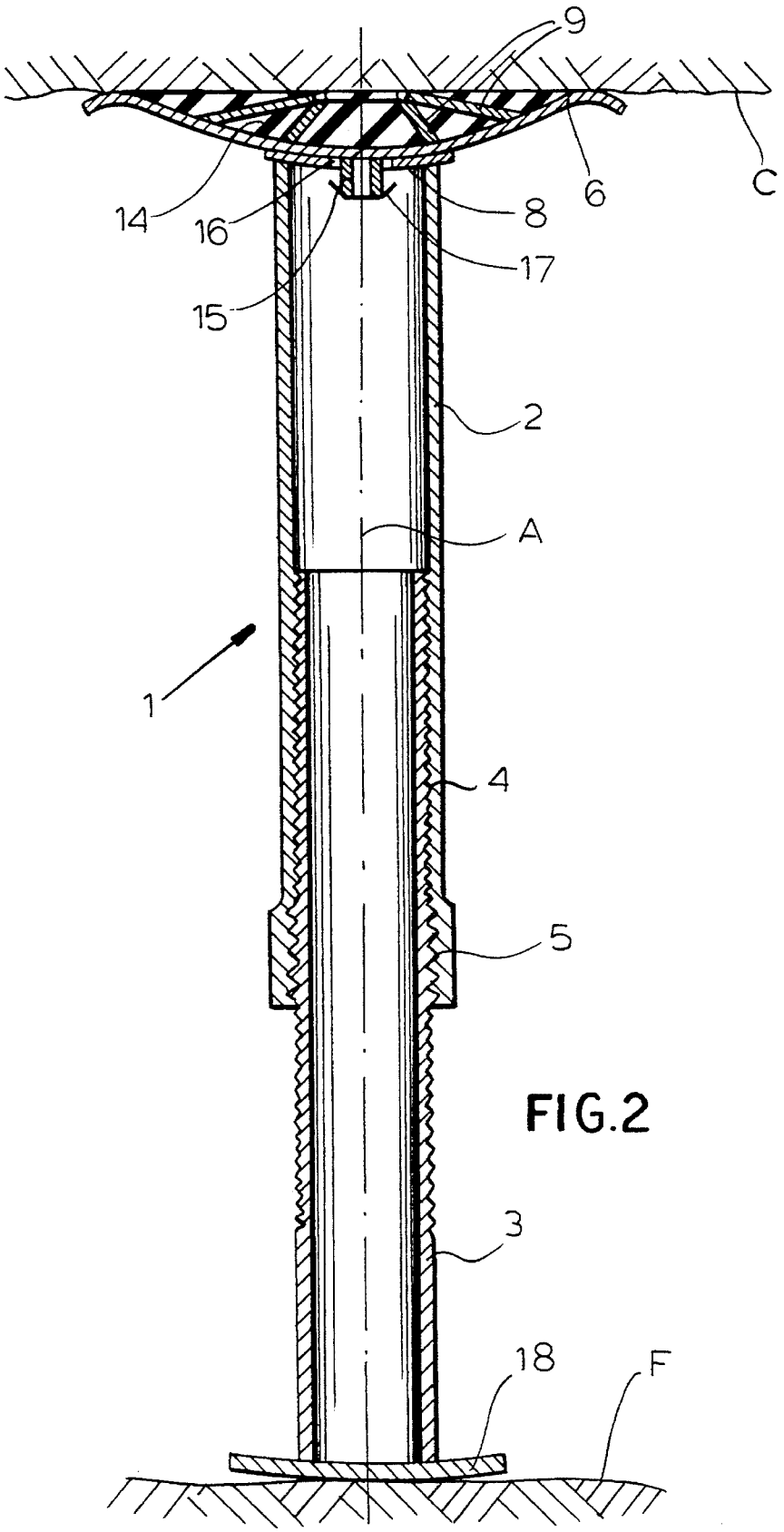
FIG. 2 is a view like FIG. 1 but showing the column or post under some compression.

In use as can be seen in FIGS. 1 and 2 the column 1 is stood upright and the outer tube 2 is screwed upward until the upper surface of the resilient element 6, 9, 14 engages the ceiling surface C. The desired amount of compression is achieved but, as visible from FIG. 2, if the ceiling C shifts somewhat it can compress somewhat more without damage to the column 1.

Figure 3:
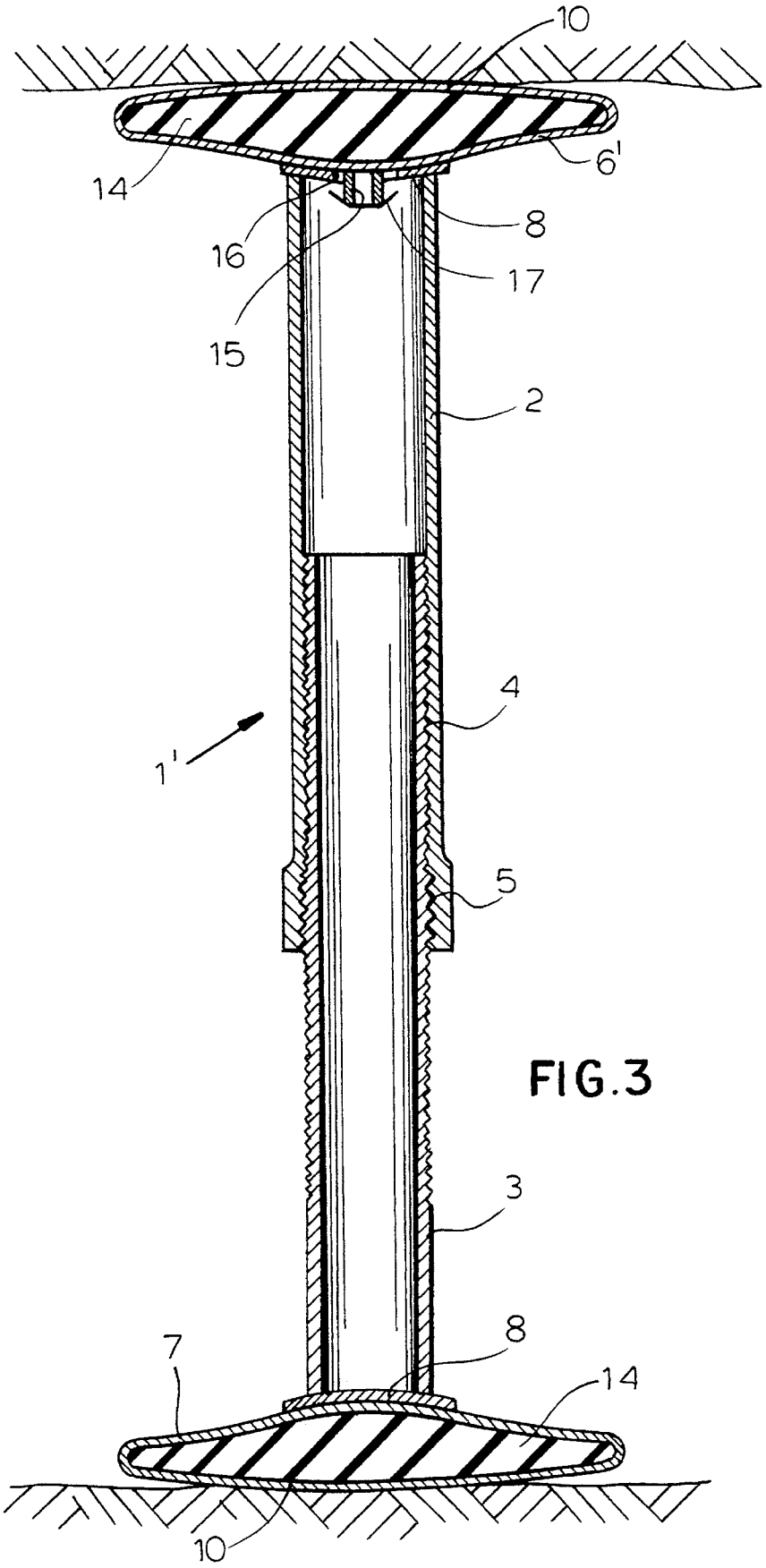
FIG. 3 is a view like FIG. 1 of another column according to the invention.

FIG. 3 shows another arrangement where a post 1' has an upper element 6' similar to that of FIG. 1 but with a closed upper wall 10 so the mass 14 is enclosed. In addition this post 1;' has an identical lower end with a disk 7 with a closed lower wall 10 and another elastomeric mass 14.

We claim:

1. An adjustable column for use between ceiling and floor surfaces of a mine, the column comprising:

an outer tube having an outer end and an inner end;

an inner tube having an inner end in the outer tube at the inner end thereof and an outer end, the tubes being coaxial to an upright axis;

an external screwthread on the outer-tube inner end;

an inner screwthread on the inner-tube inner end engaging the external screwthread, whereby the tubes can be screwed relative to each other to change the axial length of the column, one of the outer ends being operatively braced against one of the surfaces and the other outer end being spaced from the other of the surfaces and formed with a concave seat turned toward the other surface;

an elastically deformable plate sitting on the seat, concave away from the column, axially engaging the other surface, and braced axially between the seat of the other outer end and the other surface; and a body of compressible material in the plate and engaging the other surface.

2. The adjustable column defined in claim 1 wherein the inner tube is generally below the outer tube and engages the floor surface.

3. The adjustable column defined in claim 1 wherein the plate is formed with internal generally frustoconical stiffening webs flaring away from the one surface.

4. The adjustable column defined in claim 1 wherein the one surface is the ceiling surface and the plate forms with the one surface a chamber.

5. The adjustable column defined in claim 1, further comprising another such resiliently compressible support element braced axially between the one outer end and the one surface.

6. The adjustable column defined in claim 1 wherein the plate sitting on the seat is formed centrally with a pin projecting into the seat, concave away from the column, and axially engaging the one surface.

7. The adjustable column defined in claim 6, further comprising means beneath the seat secured to the pin for retaining the element in place on the seat.

8. An adjustable column for use between ceiling and floor surfaces of a mine, the column comprising:

an outer tube having an outer end and an inner end;

an inner tube having an inner end in the outer tube at the inner end thereof and an outer end, the tubes being coaxial to an upright axis;

an external screwthread on the outer-tube inner end;

an inner screwthread on the inner-tube inner end engaging the external screwthread, whereby the tubes can be screwed relative to each other to change the axial length of the column, one of the outer ends being operatively braced against one of the surfaces and the other outer end being formed with an axially outwardly concave seat and being spaced from the other of the surfaces;

an axially resiliently compressible support disk braced axially between the other outer end and the other surface and resting complementarily on the seat, the disk being concave toward the one surface and forming therewith a chamber; and a mass of resiliently deformable material filling the chamber.

* * * * *